United States Patent [19]

Watkins

[11] Patent Number: 4,840,133

[45] Date of Patent: Jun. 20, 1989

[54] NEEDLE PLATE FOR HOOK BAR OF CUT PILE TIFTING MACHINE

[75] Inventor: Charles W. Watkins, Ooltelwah, Tenn.

[73] Assignee: Tuftco Corporation, Chattanooga, Tenn.

[21] Appl. No.: 245,529

[22] Filed: Sep. 19, 1988

[51] Int. Cl.[4] ..... D05C 15/08

[52] U.S. Cl. ..... 112/80.3; 112/80.52

[58] Field of Search ..... 112/80.3, 80.52, 80.55

[56] References Cited

U.S. PATENT DOCUMENTS 4,384,538 5/1983 Slattery ..... 112/80.3

4,754,718 7/1988 Watkins ..... 112/80.52

*Primary Examiner*—Ronald Feldbaum

*Attorney, Agent, or Firm*—Harrington A. Lackey

[57] ABSTRACT

A needle plate support member including a plurality of forward projecting needle plate fingers affixed to the hook bar of a multiple needle cut pile tufting machine so that the needle plate fingers are disposed above the hooks to move simultaneously with the hooks and support the base fabric as the base fabric moves through the tufting machine.

11 Claims, 1 Drawing Sheet

NEEDLE PLATE FOR HOOK BAR OF CUT PILE TIFTING MACHINE

BACKGROUND OF THE INVENTION

This invention relates to a needle plate for a cut pile tufting machine, and more particularly to a needle plate mounted on the hook bar of the cut pile tufting machine.

One of the essential parts of practically any multiple needle tufting machine is a support for the base fabric as it moves longitudinally through the machine, and particularly as it moves beneath the needles. The base fabric requires support as the needles penetrate the fabric, which tends to force the base fabric down. Moreover, the base fabric needs to be supported as long as the loops carried by the hooks remain on the hooks, because the tension in the loops carried by the hooks exerts downward pressure upon the base fabric.

The most common and prevalent device for supporting a base fabric as it moves toward and beneath the needles in either a cut pile or a loop pile machine is the conventional needle plate. The needle plate includes a base plate mounted in front of the needles and supporting a plurality of rearward projecting needle plate fingers which extend between the needles in order to hold the base fabric while the needles penetrate the base fabric. Such basic needle plate fingers function very satisfactorily in multiple needle tufting machines in which the needles are in-line.

In multiple needle tufting machines in which the needles are staggered, whether cut pile or loop pile, the front needles are adequately supported by the rearward projecting, conventional needle plate fingers. Moreover, where the needle gauge is not too narrow, the needle plate fingers may project rearwardly far enough and be large enough to adequately support the base fabric as the rear needles penetrate the base fabric.

However, for finer needle gauges, which have become more prevalent in recent years, problems arise in supporting the base fabric in the area of rear-needle penetration because needle plate fingers which are large enough to adequately support the base fabric tend to crowd the area in which the tufts are formed. Furthermore, straight needle plate fingers which project rearwardly easily between the front needles are obstructed by the rear needles, requiring adjustments in the shapes of the needle plate fingers.

One solution to the problem of extending needle plate fingers between staggered needles is solved in the prior R. T. Card U.S. Pat. No. 2,976,829, in which the needle plate fingers are bent to provide substantial equal spacing between the needle plate fingers and the front and rear needles.

In multiple needle tufting machines in which two or more transverse needle bars are longitudinally spaced in the direction of fabric feed, supporting the base fabric as it moves beneath the extensively spaced needles presents fabric support problems which are not readily solved by the conventional needle plate, even with extended needle plate fingers of sophisticated shapes.

In the Fedevich U.S. Pat. No. 2,889,791, issued June 9, 1959, a pair of front and rear transverse needle bars, supporting respectively a plurality of transversely spaced front and rear needles, are shown cooperating with longitudinally spaced rows of looper hooks for forming two transverse rows of loop pile tufts simultaneously. In the Fedevich patent, the base fabric is supported by a plurality of longitudinally extending transversely spaced grating strips 29 which are supported at their front and rear ends by the end transverse bars 26 of grating plate sections 27. It appears that the grating strips 29 are longitudinally straight. Moreover, because of the longitudinal span of the grating strips 29, a minimum thickness of each strip 29 would be required to provide a stable support for the base fabric W.

In the Gebert U.S. Pat. No. 3,025,807, again two sets of longitudinally spaced needle bars supporting needles which cooperate with a front set of cut pile hooks and a rear set of loop pile hooks includes a throat plate 15 for supporting the rearwardly moving base fabric F. Although there is a limited disclosure of the throat plate 15, nevertheless, it appears to be of similar structure to that disclosed in the above Fedevich patent.

The Rodstein et al U.S. Pat. No. 3,402,686 discloses another tufting machine incorporating a pair of longitudinally spaced needle bars supporting needles which cooperate with two sets of corresponding cut pile hooks for forming two transverse rows of cut pile. In this patent, the base fabric 132 is supported by a fabric support or grate, which is unnumbered, but which appears to span the front and rear bed plates 138. As viewed in FIG. 5, Rodstein et al appears to disclose a plurality of transversely spaced straight longitudinal fingers or grate bars extending between the needle paths, for supporting the base fabric 132. In other words, the fabric support in Rodstein et al appears to be similar in construction to those disclosed in the Fedevich and Gebert patents. The base fabric 132 is additionally supported in Rodstein et al by the feed dogs 136 periodically as they move upward into engagement with the base fabric 132 to move the fabric rearward.

In U.S. Pat. No. 4,754,718 for "DOUBLE NEEDLE BAR TUFTING APPARATUS FOR THE FORMATION OF LOOP PILE AND CUT PILE", issued July 5, 1988 to Charles W. Watkins, and having a common assignee with this application, the base fabric moves beneath the two rows of needles supported in longitudinally spaced front and rear needle bars 12 and 13. A portion of the base fabric 28 beneath the front needles 14 is supported by a conventional needle plate having conventional needle plate fingers 26 which project between and rearwardly of the front needles 14. However, the rear portion of the base fabric 28 is supported upon a plurality of needle plate fingers 74 which are fixed to the corresponding cut pile hooks 31 in front of the rear needles and project rearwardly between the rear needles.

In the common assignee's co-pending application Ser. No. 150,759, filed Feb. 1, 1988, for "DOUBLE NEEDLE BAR LOOP PILE TUFTING APPARATUS", by the same inventor Charles W. Watkins, FIGS. 10 and 11 disclose another fabric support structure used during the formation of a pair of longitudinally spaced loop pile tufting mechanisms. FIGS. 10 and 11 disclose the front portion of the base fabric 35 being supported by conventional needle plate fingers 134 beneath the front needles 14. The rear portion of the base fabric 35 is supported beneath the rear needles 15 by a plurality of forward projecting needle plate fingers 135 which are fixed to the rear loop pile hooks 142. Thus, the rear needle plate fingers 135 move simultaneously with and are spaced above the bills of the rear loop pile hooks 142 for continuously supporting the base fabric portion beneath the rear needles 15.

The common assignee's U.S. Pat. No. 4,671,194 for "LOOPER APPARATUS FOR EQUALIZING THE LEGS OF CUT PILE TUFTS", issued June 9, 1987, discloses uniquely shaped cut pile hooks having offset portions and also needle plate fingers having offset portions cooperating in such a manner as to produce cut pile tufts having legs of equal length or depth.

SUMMARY OF THE INVENTION

It is therefore an object of this invention to provide in a multiple needle cut pile tufting machine a needle plate which is mounted on the cut pile hook bar.

Another object of this invention is to provide in a multiple needle cut pile tufting machine a needle plate mounted on the transverse hook bar in which needle plate fingers are mounted above the corresponding hooks, for movement with the hooks, and for supporting the portion of the base fabric moving over the tops of the hooks.

Another object of this invention is to provide in a multiple needle cut pile tufting machine a plurality of needle plate fingers mounted upon the transverse hook bar and above the hooks in which the top surfaces of the needle plate fingers are arcuate, convex upward in such a manner as to continuously support the base fabric in a substantially level path of movement as the hooks reciprocate in an arcuate path.

Another object of this invention is to provide in a multiple needle cut pile tufting machine having one or more transverse hook bars, a needle plate which may be affixed to each transverse hook bar for supporting a plurality of needle plate fingers above the corresponding transverse row of hooks, regardless of the number of hook bars in the cut pile tufting machine.

Another object of this invention is to provide a needle plate for mounting upon a transverse hook bar in a multiple needle cut pile tufting machine in which the needle plate fingers may have offset portions relative to the hooks to cooperate with the loops in order to form cut pile tufts having legs of equal length.

DESCRIPTION OF THE PREFERRED EMBODIMENTS

Figures 1, 2, 3, 4, 5:
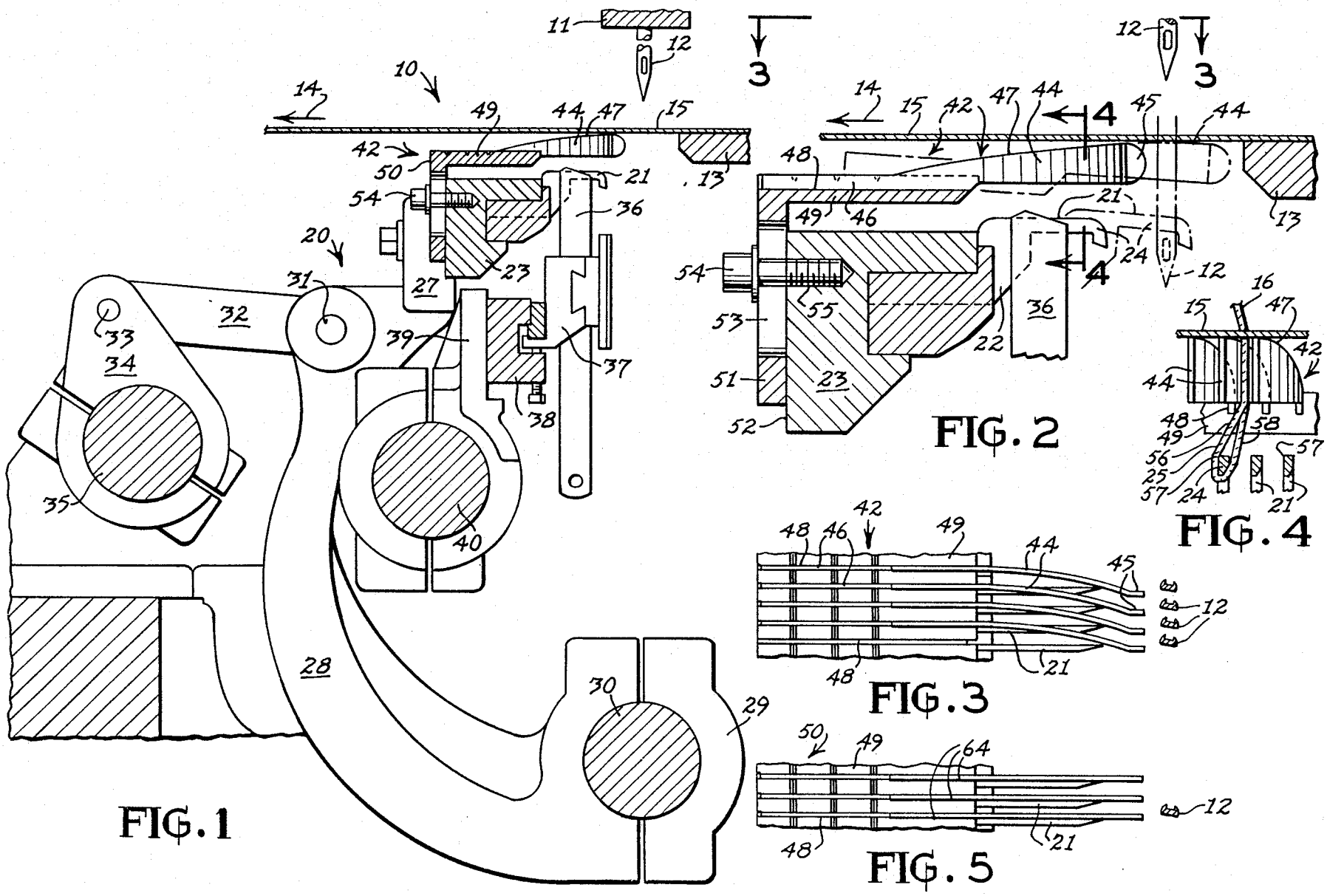
FIG. 1 is a fragmentary, sectional elevational view of a portion of a multiple needle cut pile tufting machine incorporating a needle plate made in accordance with this invention, and in which the needles and the hooks and knives are in their retracted cut pile forming positions.
FIG. 2 is an enlarged, fragmentary, sectional elevation of the cut pile hook and the needle plate in their inoperative, retracted position in solid lines and in their forward operative positions in phantom.
FIG. 3 is a fragmentary, sectional plan view taken along the line 3—3 of FIG. 2, with the base fabric removed.
FIG. 4 is an enlarged, fragmentary section taken along the line 4—4 of FIG. 2.
FIG. 5 is a fragmentary plan view similar to FIG. 3, but disclosing straight needle plate fingers.

Referring now to the drawings in more detail, FIG. 1 discloses a multiple needle cut pile tufting machine 10 including an elongated transverse needle bar 11 supporting a plurality of spaced needles 12 disposed in a row transversely of the machine 10. The needle bar 11 is operatively connected to a needle drive mechanism, not shown, for vertically reciprocating the needles 12 between the upper solid-line position of FIGS. 1 and 2, and the lowermost phantom position disclosed in FIG. 2.

Supported upon a fabric support plate 13 for movement longitudinally from front-to-rear, in the direction of the arrow 14 through the tufting machine 10, is a base fabric 15. Each needle 11 carries a yarn 16 (FIG. 4) through the base fabric 15 upon each stroke of the needle 12, in a well known manner.

The looper apparatus 20 made in accordance with this invention includes a plurality of cut pile hooks 21, there being one cut pile hook for each needle 12. Each cut pile hook 21 is provided with a shank 22 received in a corresponding slot in a cut pile hook bar 23 in a conventional manner for the assembly of cut pile hooks in a cut pile hook bar. The cut pile hooks 21 have the same transverse spacing or gauge as the needles 12 and are so arranged that the bill 24 of each cut pile hook 21 is adapted to cross and engage its corresponding needle 12 when the needle 12 is in its lowermost position, as disclosed in FIG. 2, to seize a yarn 16 and form a loop, such as the loop 25 in FIG. 4, therein. The bills 24 of the cut pile hooks 21 point forward in the direction opposite from the direction of the fabric feed 14.

The elongated, transverse cut pile hook bar 23 is fixed to a plurality of transversely spaced brackets 27, and mounted on the upper end portion of a C-shaped rocker arm 28. The lower end of the rocker arm 28 is fixed by a clamp bracket 29 to a transverse idler shaft 30. The upper portion of the rocker arm 28 is connected by a pivot pin 31 to a link bar 32, the opposite end of which is connected by a pivot pin 33 to a radial arm 34 clamped to a driven looper shaft or jack shaft 35. The looper shaft 35 is driven or reciprocably rotated by conventional looper drive means, not shown, operatively connected to the needle drive mechanism which vertically reciprocates the needle bar 11 and the needles 12.

Adapted to cooperate with each cut pile hook 21 is a knife 36 supported in a knife holder 37. The knife holder 37 is fixed to a knife block 38 which in turn is fixed by bracket 39 to the knife shaft 40 adapted to be reciprocably rotated in timed relationship with the driven looper shaft 35, by means, not shown, in a conventional manner. As disclosed in FIGS. 1 and 2, each knife 36 is adapted to cut loops 25 formed by each needle 12 upon the bill 24 of each cut pile hook 21 while the cut pile hook 21 is in its rearmost inoperative or retracted position, to form cut pile tufts, in a well known manner.

The parts thus far described are well known in the art of cut pile tufting.

Instead of a conventional needle plate fixed in the front portion of the machine having fixed rearwardly projecting needle plate fingers, a needle plate member 42 made in accordance with this invention is fixedly mounted upon the looper apparatus 20 to engage the undersurface of and support the base fabric 15 moving through the machine 10.

The needle plate member 42 includes a plurality of elongated needle plate fingers 44. Each needle plate finger 44 has a front portion 45 and a rear portion 46, as well as an elongated, relatively smooth, but arcuate top surface 47, as best disclosed in FIG. 2. Each needle plate finger 44 is preferably longer than the bill 24 of its corresponding cut pile hook 21, has a limited height, substantially less than its length, bu an even narrower width than its height. The width or thickness of each needle plate finger 44 is maintained at a minimum, to permit the needle plate fingers 44 to be spaced as closely together as possible in order to accommodate narrower needle gauges, without sacrificing strength.

The rear end portion 46 of each needle plate finger 44 is snugly received and swedged or staked in place in a corresponding elongated slot 48 formed longitudinally in the top mounting plate 49 of an elongated transversely extending mounting bracket 50. In order to affix the needle plate member 42 to a portion of the looper apparatus 20, and specifically to the hook bar 23, a substantially vertical transverse flange 51 projects downward from the rear end portion of the mounting plate 49. As disclosed in the drawings, the rear surface 52 of the hook bar 23 is vertical and substantially planar. Accordingly, the front surface of the depending mounting flange 51 is also vertical and planar to fit flush against the planar rear surface 52 of the hook bar 23. In order to secure the mounting bracket 50 upon the hook bar 23, a vertical elongated slot 53 is formed in the depending flange 51 and a mounting bolt 54 is inserted through the slot 53 and into a corresponding threaded hole 55 in the hook bar 23 to permit vertical adjustment of the bracket 50 relative to the hook bar 23.

It will be noted in FIGS. 1–3, that there is a corresponding needle plate finger 44 for each cut pile hook 21, and each needle plate finger 44 is spaced above and extends longitudinally over the corresponding cut pile hooks 21. In fact, the front portion 45 of each needle plate finger 44 projects forward farther than the free end of each of the hook bills 24.

Also in a preferred form of the invention, each needle plate finger 44 curves transversely, as best illustrated in FIG. 3. The rear portion 46 of the needle plate finger 44 is mounted in a slot 48 which is transversely offset from the cut pile hook 21 which cooperates with the same needle 12 as the corresponding needle plate finger 44. The amount the slot is offset increases with the increase in pile height. Although the rear portion 46 of each needle plate finger is essentially straight in order to be received in its corresponding straight groove or slot 48, the middle or unmounted portion of each finger 44 curves forward until it terminates in a substantially vertically flat, rounded front end portion 45 substantially in vertical planar alignment with its corresponding cut pile hook 21, as best disclosed in FIG. 3.

Thus, the front end portion 45 will cross on the same side of its corresponding needle 12 as the corresponding cut pile hook 21. The cut pile hook 21 will cross the same needle 12 after the front end portion 45 crosses the needle 12. After the front end portion 45 of a needle plate finger 44 crosses a needle 12 in its lowermost position, as disclosed in phantom in FIG. 2, then the corresponding bill 24 of the cut pile hook 21 crosses the same needle 12 on the same side to catch or seize the loop 25. As the hooks 21 retract, and as the base fabric 15 continues moving toward the rear, the loop 25 caught on the bill 24 will move rearward with the cut pile hook 21 and will move toward the rear of the bill 24, so that the loop 25 will be intercepted and cut by its corresponding knife 36.

While the loop 25 is moving rearwardly along and with the bill 24 of the hook 21, the upper portion of the loop is guided toward the right of the corresponding looper hook 21, looking rearwardly, in order to cause the left leg 56 of the loop 25 to extend around the upper left corner 57 of the bill 24, as illustrated in FIG. 4, in order to lengthen the left leg 56 in relation to the right leg 58. Thus, when the knife 36 cuts the loop 25, the legs 56 and 58 will be equal when they again assume their free depending position.

Thus, the needle plate fingers 44 function in a manner similar to the hook bills and needle plate fingers disclosed in U.S. Pat. No. 4,671,194.

FIG. 5 discloses a fragment of the mounting bracket 50, including the mounting plate 49 and the longitudinal slots 48, receiving corresponding elongated, but straight, needle plate fingers 64. Otherwise, the needle plate fingers 64 are identical to the needle plate fingers 44, except the needle plate fingers 64 are straight instead of curved in the transverse dimension. Otherwise, the needle plate fingers 64 have substantially the same length, height, and thickness as the needle plate fingers 44 and the same shape, including the arcuate shape of the top surface 47. However, each needle plate finger 64 is mounted in a slot or groove 48, which is substantially in vertical alignment with its corresponding needle 12 and cut pile hook 21, as illustrated in FIG. 5.

It will be noted in the above description that all of the needle plate fingers 44 or 64, move continuously with the corresponding hook bar 23 and the hooks 21, so that the needle plate fingers 44 and 64 are always located above and over their corresponding cut pile hooks 21. Thus, the needle plate fingers 44 and 64 are always in a position for supporting the base fabric 15 as it moves over the hooks 21.

The height of the needle plate fingers 44 is readily adjustable by means of the bolt 54 and slot 53 to accommodate various pile heights by raising and lowering the top surfaces 47 of the needle plate fingers 44 and 64 to different support levels for the base fabric 15 as the fabric 15 moves rearwardly through the machine.

Furthermore, the longitudinal arcuate configuration of the top surface 47 generally has the configuration of a circle whose center is the center of the idler shaft 30. Therefore, most points along the top surface 47 are maintained at the same level, as the needle plate finger 44 moves beneath its corresponding needle 12, thereby assuring a substantially longitudinally continuous level or substantially horizontal support for the moving base fabric 15.

It will also be seen that, in a multiple needle tufting machine incorporating a plurality of longitudinally spaced transverse needle bars together with longitudinally spaced cooperating cut pile looper apparatus, each transverse row of hooks or hook bars may readily be provided with a corresponding uniform needle plate member 42 without regard to the longitudinal spacing of the needle bars 11 or the hook bars 23, or even the number of hook bars 23.

It will also be understood that the needle plate fingers 47 might be affixed directly to the top or the rear or any other portion of the hook bar 23. Furthermore, the needle plate fingers 44 might be mounted to some other portion of the looper apparatus 20, so long as the adjustable relationship between the cut pile hooks and the needle plate fingers is maintained.

What is claimed is:

1. In a cut-pile tufting machine having a plurality of needles for introducing yarns through a base fabric movable front-to-rear in a longitudinal path through the machine to form transversely spaced, longitudinal rows of loops, a transversely extending hook bar supporting a plurality of cut pile hooks having bills projecting forward, knives for cooperating with said hooks to cut said loops, means for reciprocably moving said hook bar longitudinally below said longitudinal path between a forward operative position cooperating with a corresponding needle to form a loop and a rearward position cooperating with a corresponding knife for cutting said loop to form a cut pile tuft, means supporting said base fabric comprising:

(a) a plurality of elongated needle plate fingers having front and rear end portions, (b) support means mounting the rear end portions of said needle plate fingers on said hook bar to cause said front end portions to project forward above said hooks, (c) said front end portions projecting forward far enough to extend between corresponding needles when said hooks are in said forward operative positions, and (d) said needle plate fingers having top surfaces supporting said base fabric as said base fabric moves longitudinally through said machine.

2. The invention according to claim 1 in which said support means comprises bracket means in which said rear end portions are mounted, and means affixing said bracket means on said hook bar to mount said needle plate fingers above said hooks.

3. The invention according to claim 2 in which said bracket means comprises a transverse mounting plate having longitudinal parallel grooves, said rear end portions of said needle plate fingers fitting in said corresponding grooves.

4. The invention according to claim 3 in which said bracket means further comprises a rear flange depending from said mounting plate, and means for securing said depending flange upon the rear end portion of said hook bar for vertical adjustment of said mounting plate relative to said hook bar.

5. The invention according to claim 1 in which the front end portions of said needle plate fingers are curved transversely in one direction to guide loops formed by said corresponding needles and cut pile hooks transversely of said corresponding hook as said base fabric moves rearwardly through said machine, each of said knives cooperating with its corresponding hook to cut each corresponding loop to form a cut pile tuft having substantially equal legs.

6. The invention according to claim 1 further comprising a transversely extending hook bar supporting a plurality of cut pile hooks having corresponding bills projecting forward, said hooks being transversely spaced on the same gauge as said needles, means for reciprocably moving said hook bar longitudinally between a forward operative position in which the bill of each hook cooperates with a corresponding needle penetrating the base fabric to form a corresponding loop, and a rearward position, a knife for each cut pile hook, means for reciprocably moving said knives to cooperate with said corresponding hooks to cut loops formed on said hooks in said rearward position to form cut pile tufts, said means for reciprocably moving said hook bar comprising means for moving said hooks in parallel vertical planes and in arcuate paths, said support means mounting said needle plate fingers to move in arcuate paths above said hooks, so that the top surfaces of said needle plate fingers substantially continuously support said base fabric as said base fabric moves through said machine.

7. The invention according to claim 6 in which the top surfaces of at least the front portions of said needle plate fingers are longitudinally arcuate.

8. The invention according to claim 6 in which the length of each of said needle plate fingers is at least as long as the length of the bills of said corresponding cut pile hooks.

9. The invention according to claim 8 in which the length of each said needle plate finger is substantially greater than the length of the bill of said corresponding cut pile hook.

10. The invention according to claim 6 in which said front end portion of each needle plate finger projects farther forward than the bill of said cut pile hook.

11. The invention according to claim 6 in which said hook bar has a rear substantially vertical planar surface, said support means comprising an angle-shaped bracket including a transverse mounting plate holding the rear end portions of said needle plate fingers and including a depending flange adapted to fit flush against the rear surface of said hook bar, and means for adjustably connecting said depending flange to the rear surface of said hook bar for vertical adjustment of said mounting plate relative to said hook bar.

* * * * *